US005121589A

United States Patent [19]

Ventura et al.

[11] Patent Number: 5,121,589

[45] Date of Patent: Jun. 16, 1992

[54] APPARATUS AND PROCESS FOR THE AUTOMATED PACKING OF LETTUCE

[75] Inventors: Leon P. Ventura, Watsonville; Javier Diaz-Infante, Salinas; Edward Wynn, Monterey; Peter deGroot, Marina; Anna M. Boeh, San Jose, all of Calif.

[73] Assignee: Bud of California, Salinas, Calif.

[21] Appl. No.: 754,998

[22] Filed: Sep. 5, 1991

[51] Int. Cl.[5] ..... B65B 25/04; B65B 5/06; B65B 35/30; A01D 33/10

[52] U.S. Cl. ..... 53/448; 53/475; 53/537; 53/538; 53/543; 53/240; 53/244; 53/247; 53/258; 53/391; 56/16.6

[58] Field of Search ..... 53/448, 475, 443, 152, 53/158, 154, 537, 538, 543, 240, 258, 391, 245, 244, 247; 56/16.6

[56] References Cited

U.S. PATENT DOCUMENTS

| | | | |
|---|---|---|---|
| 2,699,877 | 1/1955 | Huston | 53/391 X |
| 2,804,739 | 9/1957 | Martin | 53/391 |
| 2,825,573 | 3/1958 | Shaw et al. | 53/391 UX |
| 3,001,350 | 9/1961 | Heblij | 53/245 |
| 3,338,009 | 8/1967 | Stevens | 53/245 |
| 3,984,964 | 10/1976 | Stoll | 53/543 |
| 3,991,539 | 11/1976 | Luca | 53/448 |
| 4,168,597 | 9/1979 | Cayton | 53/391 X |
| 4,259,826 | 4/1981 | Campbell | 53/543 |
| 4,277,932 | 7/1981 | Campbell | 53/543 X |
| 4,884,388 | 12/1989 | Ventura et al. | 53/258 X |

*Primary Examiner*—Horace M. Culver
*Attorney, Agent, or Firm*—Townsend and Townsend

[57] ABSTRACT

A lettuce head holding tray is defined in which both the upper tray layer and the lower tray layer are packed side-by-side at packing stations. At a carton loading station, two side-by-side arrays of plungers each are used for packing of discrete layers of the cartons. One array of plungers packs the bottom carton layer; the other array of plungers packs the top carton layer. Two cartons are disposed opened upwardly to the plunger array at the packing station; one carton is disposed to the bottom layer loading plunger array for packing of the bottom layer and the other carton—with its bottom layer previously packed—is disposed to the top layer loanding plunger array for packing of its top layer. The cartons—between the packing of the bottom layer and the packing of the top layer—are conveyed between positions underlying the plunger arrays. Thus each carton has is lower layer packed by the lower layer loading plunger array and then its top layer packed by the upper layer loading plunger array.

25 Claims, 11 Drawing Sheets

APPARATUS AND PROCESS FOR THE AUTOMATED PACKING OF LETTUCE

This invention relates to the automated packaging of lettuce and other produce similar to lettuce. Specifically, improvements are set forth to that automated packaging apparatus set forth in Ventura et al. U.S. Pat. No. 4,884,388 entitled LETTUCE PACKER issued Dec. 5, 1989. The improvements set forth herein relate to an improved tray, a double packing station for packing the top box layer of one box side-by-side with the bottom box layer of an adjacent box, and a combination of conveyers and tray elevators which optimize the automated packing speed of the lettuce.

BACKGROUND OF THE INVENTION

In the Ventura et al. U.S. Pat. No. 4,884,388 for LETTUCE PACKER, an apparatus was set forth for producing by automated lettuce packing, a carton of packed lettuce that was superior to a similar carton packed by hand. This apparatus, so far as is relevant herein, can be summarized by first describing the lettuce holding trays, secondly setting forth the configuration of the packing station (hereinafter referred to as the "plunging station"), and thereafter describing briefly the superiority of the resulting packed carton over the hand packed carton of the prior art.

The Ventura et al. Patent disclosed a lettuce holding tray. The purpose of the tray was to hold packed lettuce, transport the packed lettuce, and allow the lettuce to be moved as packed from the tray to an awaiting carton for shipment in the carton to market.

The type of packing here utilized is the so-called "naked pack" of lettuce within a carton. In the naked pack technique, lettuce heads are placed side-by-side within a carton without the lettuce being either wrapped or held by separating material.

The trays are fabricated to hold a single layer of lettuce being placed within a box. Lettuce is typically packed two layers high within a receiving box. Each of these layers includes the placement of four rows of lettuce in packed side-by-side relation with each row being three heads wide.

The tray includes longitudinal and transverse upper members defining a matrix of interstitial lettuce receiving cells therebetween. The defined matrix circumscribes individual cells surrounding each head of lettuce in a layer of a box. Thus the matrix of the tray defines a series of lettuce receiving cells having four rows, each row with three side-by-side positions for receiving a total of twelve heads of lettuce.

Cell sides are provided for allowing the lettuce placed in each cell to be held in each cell and further for permitting lettuce to be packed from each cell by being plunged out of the cell through the bottom of the tray. Specifically, the cell sides comprise sheets of flexible material fastened at the top to the matrix. The sheets of flexible material depended from the matrix inwardly of each cell. These flexible tray sides are preferably fabricated from stainless steel sheet metal.

The function of the flexible sides of the cells of the tray is easily understood. Lettuce placed within the cell is oriented to the desired packed disposition in the carton and thereafter held to the cell by the flexible sides in its desired orientation. A fully packed tray having the lettuce held in each cell therein can be transported from a station where it is packed to another station where it is plunged to a carton.

The removal of the lettuce from the tray is likewise easy to understand. Specifically, an array of plungers is utilized. Similar to the rows of cells in the lettuce receiving tray, the plunger array includes four rows of three side-by-side plungers. These plungers are oriented to and toward a tray positioned between the overlying plungers and the underlying carton.

The plungers simultaneously move through a tray packed with heads of lettuce oriented to their desired packed orientation. The lettuce moves out of the tray and into the carton without changing the original orientation that the lettuce had in the holding and transporting tray. Packing of a single layer of the carton occurs with a single simultaneous stroke of the twelve plungers of the plunger array.

In the Ventura et al. Patent, a single array of twelve plungers was utilized. Consequently, packing of the lower layer of a lettuce carton first occurs. Thereafter—and utilizing the same plunging mechanism—packing of the upper layer occurs. There results a packed carton of lettuce having demonstrably improved characteristics.

The superiority of the machine packed lettuce can be summarized. The heads of lettuce as packed by the plungers move without relative rotation one to another as they pass from the tray to the carton. An entire layer of the lettuce carton is packed by the plunger array at a single stroke; this is an operation that is not possible to duplicate by hand. There results a regularity in the packing of each of the two layers of the carton that is readily discernable upon the opening of the carton. The outer lettuce leaves of the carton form an almost square perimeter. These leaves of lettuce, while having this square perimeter, have minimal spoilage. This regularity of lettuce head packing enables the product to be shipped with greatly reduced damage. As a consequence, cartons of lettuce packed in accordance with this "naked" pack technique ship with less deterioration to the conventional hand packed "naked" lettuce and command a premium price over conventional hand packed lettuce equivalents.

The Ventura et al. Patent illustrates the above techniques in their prototype formats. It is the purpose of this disclosure to set forth a commercially viable plunging station, associated conveyors, and elevators for providing optimized picking and packing by lettuce pickers with optimized transport and plunging to cartons at plunging stations.

SUMMARY OF THE INVENTION

A lettuce head holding tray is defined in which both an upper carton layer and a lower carton are loaded side-by-side at the plunger stations. Each tray therefore can receive and transport twenty four heads of lettuce with the tray including eight rows of lettuce receiving cells with each row being three cells wide; four rows three cells wide on one tray side define the bottom layer of a carton to be packed while four rows three cells wide on the opposite tray side define the top layer of a carton to be packed.

At the plunging station, two side-by-side arrays of twelve plungers each are used for loading of the cartons. One array of twelve plungers packs the bottom carton layer; the other array of twelve plungers packs the top carton layer. Two cartons are disposed opened upwardly to the plunger array at the plunger station;

one carton is disposed to the bottom layer loading plunger array for packing of the bottom layer and the other carton—with its bottom layer previously packed—is disposed to the top layer loading plunger array for packing of its top layer. The cartons—between the packing of the bottom layer and the packing of the top layer—are conveyed between positions underlying the plunger arrays. Thus each carton has its lower layer packed by the lower layer loading plunger array and then its top layer packed by the upper layer loading plunger array.

A system of paired vertically stacked conveyors at two discrete elevations is provided for supplying the plunging station with trays. The lower conveyor supplies full lettuce holding trays to be packed. The upper conveyor conveys away the empty lettuce holding trays once their respective lettuce head contents have been packed.

Packing of the lettuce trays to the cartons occurs from an elevation even with the upper conveyor. Consequently, an elevator is required for lifting the full lettuce holding trays to the elevation of the upper empty tray conveyor from the lower full tray conveyor.

A specialized elevator having upper and lower tray holding stations is disclosed along with a cycle which minimizes that time interval required for loading the plunging station with a full tray of lettuce to be plunged. According to this aspect, the elevator is given two tray holding stations —an upper tray holding station for holding an empty lettuce tray and a lower tray holding station for holding a full lettuce tray. These respective lettuce holding stations are separated by a vertical interval that matches the vertical interval between the upper and lower conveyors. Presuming that the elevator is registered with its upper tray holding station to the elevation of the plunger station and that the lower tray holding station is even with the lower conveyer supplying full lettuce trays, the cycle can be easily understood.

Simultaneously with discharge of an empty tray from the plunger station to the upper elevator station, a full tray is moved from the loaded tray conveyor to the lower elevator station. When the elevator is loaded with a full lettuce tray at the bottom station—and typically before an empty tray is discharged at the upper elevator station to the upper empty tray conveyor—the elevator is raised so that its lower tray holding station having the full tray of lettuce is even with the plunger station. When registration of the lower station of the elevator occurs even with the plunger station, a full tray of lettuce is immediately discharged from the elevator to the plunger station for plunging to paired cartons at their respective upper and lower layers. Upon completion of the discharge, the elevator returns to its lowered disposition with its empty lower station and an upper station usually containing an empty tray. Upon return to a lowered position wherein registry of both elevator stations to both conveyors occurs, loading of the lower elevator station with a full lettuce tray occurs at the same time that any empty tray is discharged from the upper elevator tray holding station.

Once plunging of the full tray at the plunger station occurs—unloading of the plunger station with its now empty lettuce holding and transporting tray occurs to the upper tray holding station on the elevator. This disclosed cycle thereafter continuously repeats with only one variation. Where sufficient time interval permits, the empty tray from the plunging station is sometimes conveyed entirely across the upper tray holding station of the elevator without being stopped, raised, and then lowered before conveyance to the upper conveyor having the empty trays thereon. Thus it will be understood that the priority of the conveyor and elevator cycle is always for maintaining the shortest possible time interval between the time a full tray is loaded to the plunger station for packing of the cartons below and the time a tray is plunged and becomes empty at the plunger station.

BRIEF DESCRIPTION OF THE DRAWINGS

FIG. 5B illustrating the elevator returned to the lower position with upper elevator station discharging its empty tray to the upper conveyor, the empty lower station receiving a full tray from the lower conveyor, and the simultaneous plunging of the full tray at the plunger station into respective paired cartons disposed below the plunger station with one carton having its lower layer packed and the remaining adjacent, carton having its upper layer packed; and, FIG. 5C illustrating a variation of the cycle in which the upper empty tray is conveyed entirely across the upper elevator station before raising and lower of the elevator occurs to load a full tray to the plunger station;

DESCRIPTION OF THE PREFERRED EMBODIMENT

Figure 1A:
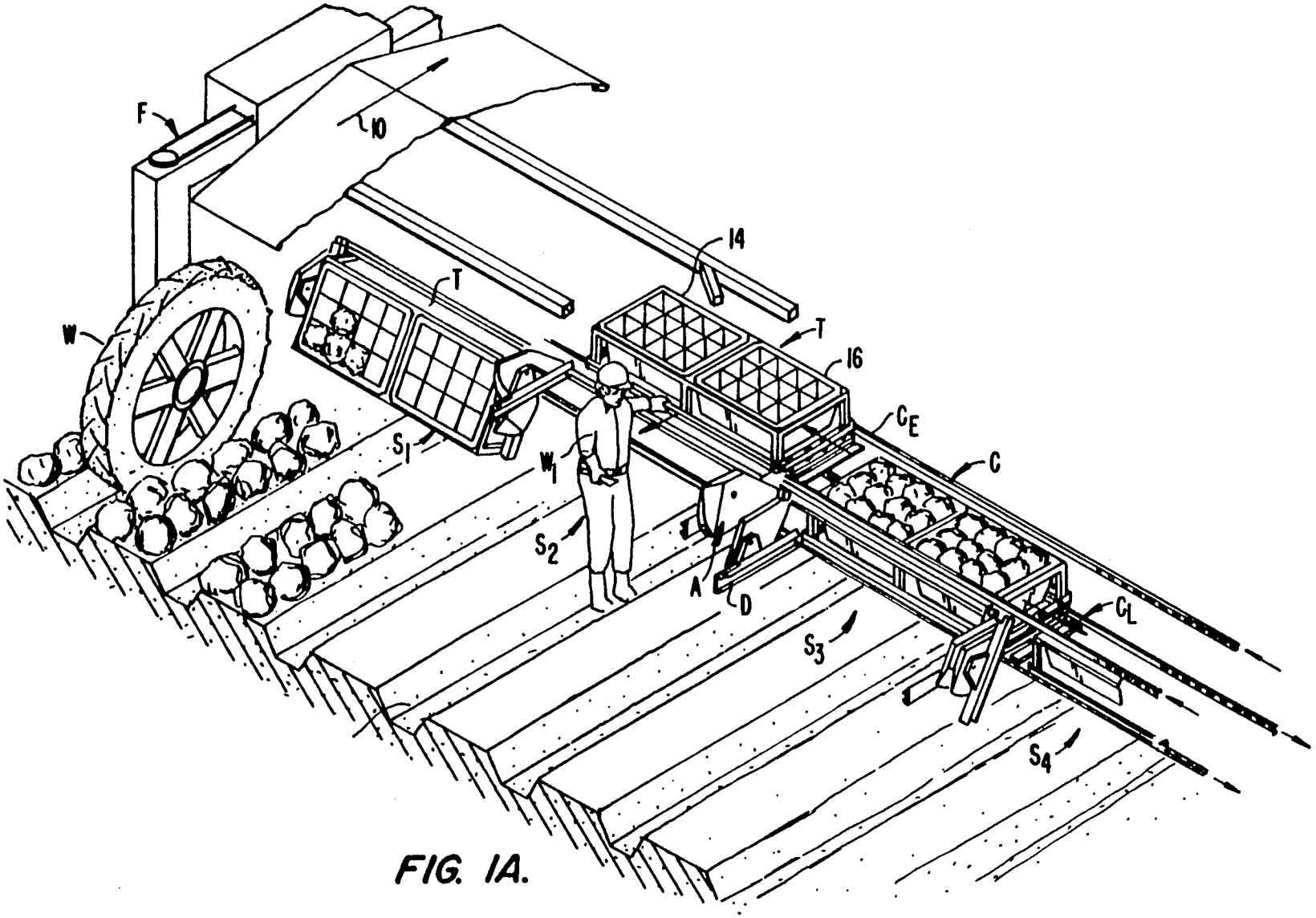
FIGS. 1A and 1B are a perspective view of a lettuce packing and carton plunging machine according to this invention with FIG. 1A illustrating the left hand of such a machine including packing stations and conveyors and FIG. 1B illustrating the right hand of such a machine including the ends of the respective conveyors, the carton plunging station, and the elevator therebetween.
Figure 1B:
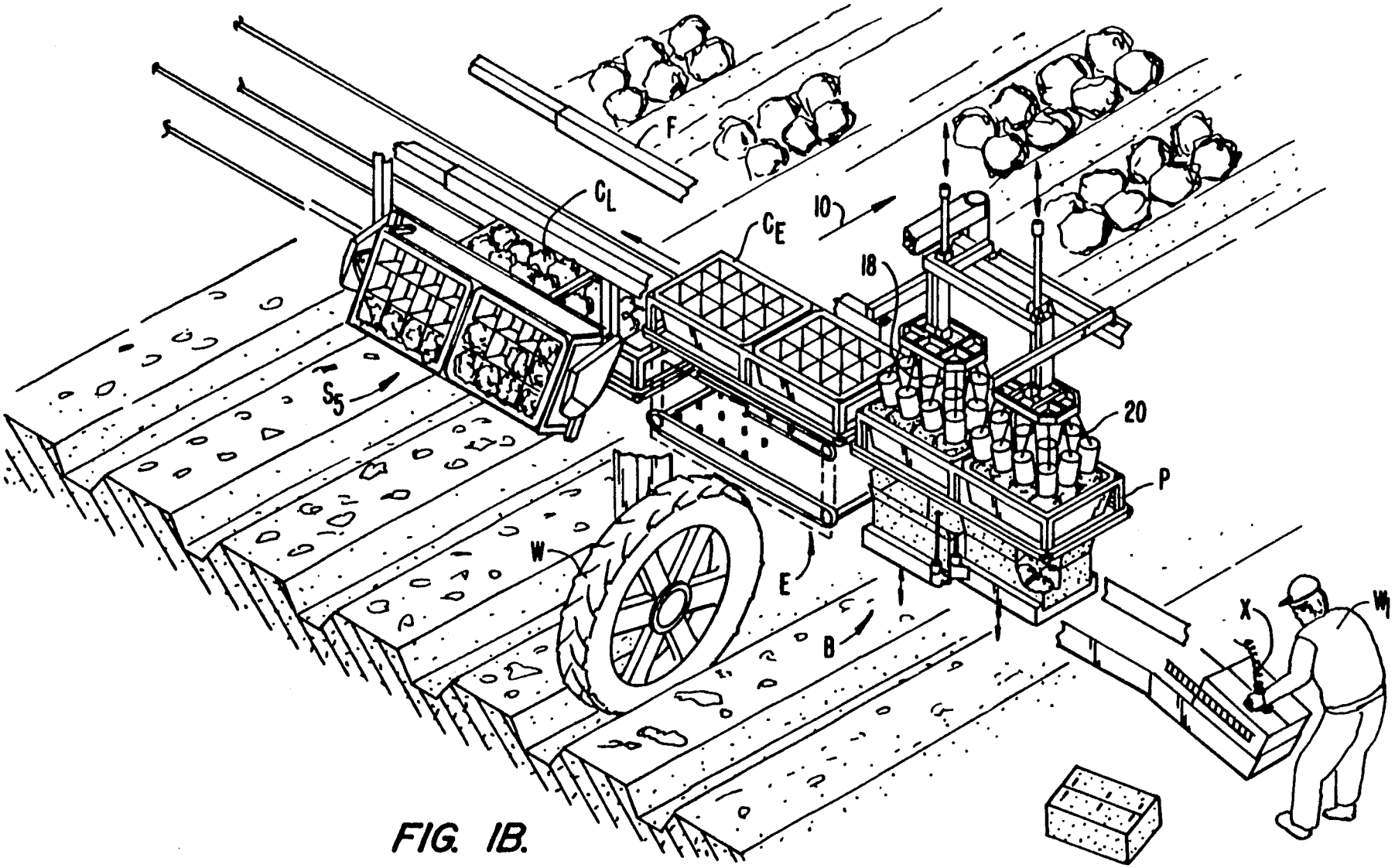

Referring to FIGS. 1A and 1B, the overall configuration of this invention may be understood. The harvester of this invention includes an elongate frame F mounted on wheels W. When transport of the frame F occurs over rows R containing a crop such as lettuce, the longitudinal axis of frame F is normal to the row R.

Wheels W are typically each driven by individually powered hydraulic motors. The wheels are phase locked and driven in an equal speed in their rotation to assure uniform transport of frame F transversely of a field having a crop of lettuce planted in rows R.

Frame F supports five packing stations S1–S5. These respective packing stations are typically on the trailing side of the machine which preferably traverses the field in the direction of arrows 10. As will hereafter fully be made clear, the transport of frame F is reversible. Consequently, packing stations S1–S5 can be disposed from both sides of frame F. Normally, the machine is attended by approximately eleven picking workers, and three workers attending the lettuce plunging apparatus P which effects the automated packing of the lettuce in cartons for shipment to market.

The trays T each contain twenty-four heads of lettuce. As will hereinafter be more fully explained, a first half of the tray of each tray 14 contains the bottom packed layer of a box of lettuce; the second half of the tray 16 contains a top half of a carton of packed lettuce.

During picking, the tray T occupies an angular position inclined on the order of 15° from the vertical. The individual lettuce receiving cells of the tray are addressed to the trailing side of the machine as shown in FIG. 1A at station S1. In this position the lettuce can most conveniently be placed into the individual cells of the tray T to fill the tray with 24 heads of freshly picked lettuce.

When the tray is full, it is pivoted on a cradle D attached to arms A. Such pivot enables rolling transport of the full tray of lettuce occurs to a lower conveyor $C_L$ of a conveyor pair C. Thereafter, cradle D is pivoted on arms A and elevated to an upward position as shown at station S2 and an empty tray pulled onto the cradle. The cradle thereafter falls under the weight of gravity to the position illustrated in FIG. S1.

Thus, it will be seen that the packing station of this invention accomplishes two purposes. First, it affects a conveyance of the trays T from the empty conveyor $C_E$ to the lower loaded conveyor $C_L$. Secondly, and during this transport between the two conveyors, it disposes the tray T in a position where it may be most conveniently packed with lettuce as at station S1.

Conveyors $C_L$ and $C_E$ serve to convey the trays between the stations S1–S5 where picking occurs and an elevator E. Elevator E serves to elevate the loaded trays T from conveyor $C_L$ to a plunger mechanism P. Plunger mechanism P has the function of packing lettuce cartons transported on a box conveyor B. Twelve plungers 18 pack the portion 14 of tray T to a bottom layer of a first carton. Likewise, twelve plungers 20 pack the top layer of a tray T at portion 16 to a carton. Thus, it can be seen that each lettuce tray is simultaneously packed into the bottom portion of a carton at portion 14 and the top portion of a carton at adjoining portion 16. The carton, when fully packed, is thereafter transported to a stapling station X for closure and discharge to transport apparatus where transport to a cooler followed by refrigerated shipment to market occurs.

Having summarized the overall operation of this invention, attention will now be directed in detail to the discrete portions of this invention.

Lettuce Receiving Tray

Figure 2:
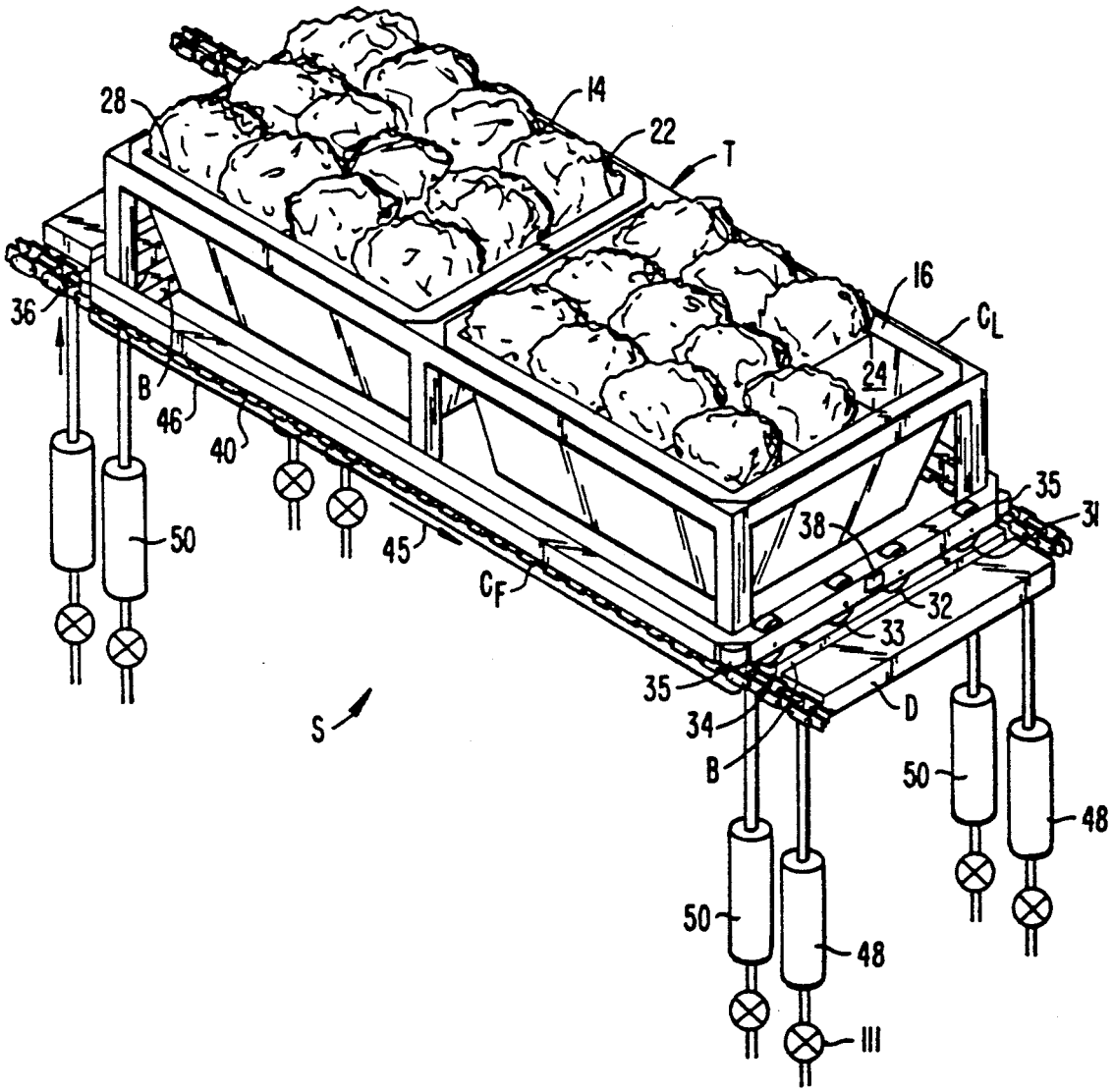
FIG. 2 is a perspective schematic of a typical conveyor illustrating the conveyed tray, a dam for stopping the tray in the vicinity of one of the packing stations, and the cooperating bridge lifts for enabling transport of the tray to and from the conveyors.

Referring to FIG. 2, tray T is illustrated. As can be seen, it includes in section 14, twelve discrete cells 22. These discrete cells are for holding the bottom layer of lettuce packed within the box. Heads of lettuce packed to this section of the tray are disposed with their respective butts downward; in this disposition these lettuce head butts confront the bottom of the cartons into which they are placed.

Additionally, and at section 16 of tray T, twelve discrete cells 24 are utilized. These discrete cells are for holding the top layer of lettuce packed within the box. Heads of lettuce packed to this section of the tray are disposed with their respective butts to the side; in this disposition these lettuce head butts are disposed to the sides of the cartons into which they are placed. When disposed to the sides, these lettuce head butts are disposed interstitially of the otherwise tightly packed lettuce where they may not damage the lettuce leaf of adjacent tightly packed lettuce heads.

The tray construction of each half 24, 26 of the tray is more fully described in Ventura, et al., U.S. Pat. No. 4,884,388, entitled "Lettuce Packer", issued Dec. 5, 1989, which application is incorporated by reference herein. It is to be noted that this patent only describes one tray half 14 or 16; it does not disclose or suggest the double tray herein utilized.

The tray T has two modes of transport. One mode of transport is conventional transport parallel to the longitudinal axis of the tray on conveyors C. In this transport mode, the tray T is supported on a chain 40 and conventionally carried by the chain parallel to its major longitudinal axis.

In the second mode of transport, the tray T undergoes rolling transport. In this transport mode, the tray T is supported on wheels, pulled or pushed by workers parallel to its minor axis (and normal to the longitudinal axis) for movement off of and onto conveyors C.

Referring to FIG. 2, it will be seen that two discrete sets of rollers are included with each tray. There are bottom exposed rollers 31–34, which rollers enable the tray to be rolled to and from a chain conveyors C.

Rollers 35, 36 are placed at the corners of the tray. These rollers enable the tray to pass on guides longitudinally of the conveyors $C_F$, $C_E$.

Finally, side rollers 38 are exposed on each end of tray T. These respective side rollers 38 enable the tray to pass in and out of the cradle D as tray T move to and from the respective conveyor C.

As is conventional, the bottom of the tray has an anti-friction, anti-wear material, preferably ultra-high molecular weight polyethylene (not shown). The tray is conveyed on a endless chain 40, which endless chain continually moves. This endless chain bears directly against the ultra-high molecular weight polyethylene and enables the tray either to be transported with chain 40 or to remain stationary while chain 40 passes underneath the tray T.

Conveyor, Dams and Bridge Lifts

The conveyors C at empty conveyor $C_E$ and loaded conveyor $C_L$ are conventional. Their detail will be abbreviated. Typically, chain conveyors C at endless chains 40 support the tray T as the trays T are conveyed along the frame F. These conveyors move at one foot to one foot and one half per second and are normally on. 20 At each of the stations S1-S5 on each of the conveyors $C_E$-$C_L$, there are a system of dams and bridge lifts. It is the function of the dams to stop and register the trays to each of the stations S. It is the function of the bridge lifts to enable the rolling transport to and from the conveyors.

Referring to FIG. 2, a typical dam D and bridge lifts B are illustrated. Conveyor $C_F$ is shown conveying in the direction indicated by arrow 45. This conveyor has permanently installed side guides 46 on either side, which guides 46 maintain the longitudinal alignment of the tray T. Endless chain 40 runs in conventional raceways which are not shown. The tray is being conveyed to the particular station S shown in FIG. 2.

Each station S includes two bridge lifts B and a dam D.

With respect to dam D, it includes a pneumatic actuating mechanism 48, which mechanism 48 moves the dam D between a lowered position where the tray T may freely pass over the dam and a raised position where the tray T abuts and stops against the dam D. When dam D, commonly constructed of metal, is raised, tray T on the chain is conveyed along until collision occurs with the raised dam D. This causes the tray T to stop at the correct position with respect to station S. Moreover, the tray T is registered to the station S so that either removal or loading of the tray T can occur.

Bridge lifts B function to permit the tray T to be moved at right angles to the conveyor $C_L$. When the bridge lifts B are up as by the actuation of the pneumatic cylinders 50, rolling transport of the tray T on wheels 31-34 can occur. When the bridge lifts are lowered, the tray can pass over the bridge lift as well as be deposited on the endless conveyor chain 40 for transport. Pneumatics for the operation of the bridge lifts is schematically shown.

It will be understood that the view of FIG. 2 is illustrated for a station S on lower conveyor $C_L$ which conveys trays T packed with heads of lettuce. The structure at conveyor $C_E$ is analogous; it is therefore not shown. However, it will be understood that conveyance is in the opposite direction. Consequently, dams D are at the opposite end of the tray T.

Figure 3A:
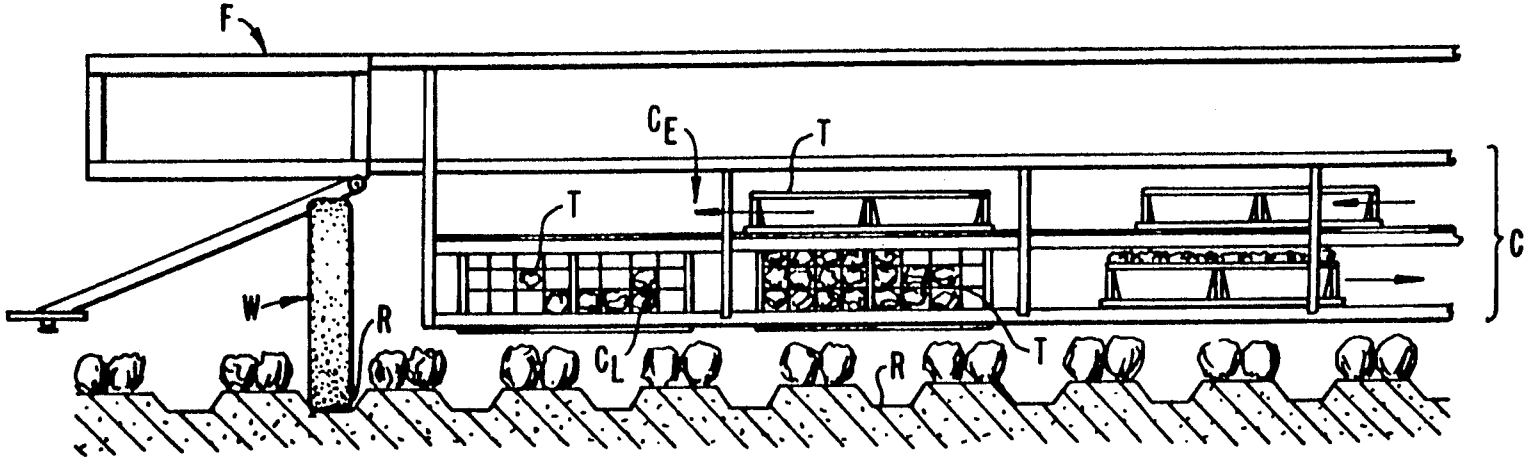
FIGS. 3A and 3B are a side elevation of a lettuce packing and plunging machine with FIG. 3A illustrating the relative elevations of the trays disposed for packing, the upper conveyor supplying the empty trays to the packing stations, and the lower convey supplying the full trays and with FIG. 3B illustrating the end of the respective conveyors, the plunging station, and the elevator disposed therebetween.
Figure 3B:
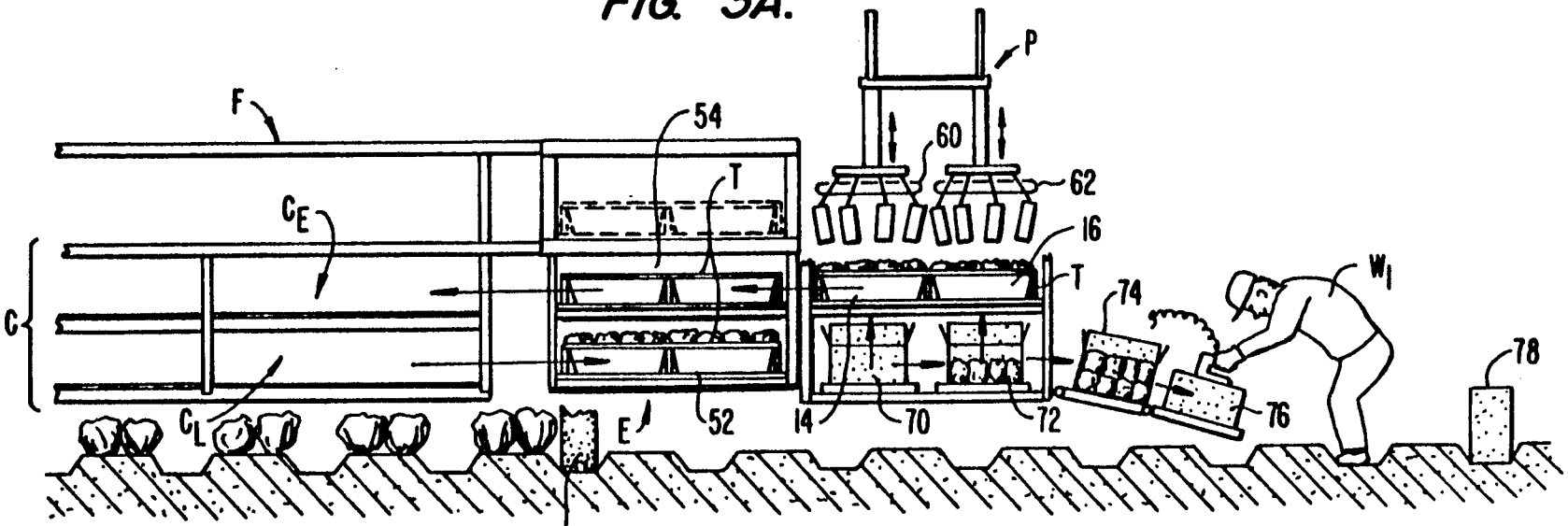

Referring to FIGS. 3A and 3B, the overall organization of frame F is seen in side elevation, it being noted that illustration of the packing stations S is omitted. Specifically upper conveyor $C_E$ receives and dispenses to the respective packing stations empty trays T. Lower conveyor $C_L$ receives full trays and dispenses these respective trays to an elevator E (see FIG. 3B).

Elevator E is a two-station device. Specifically, it includes a lower station $E_L$ and an upper station $E_E$. It is the function of lower station $E_L$ to receive full trays from lower conveyor $C_L$ and thereafter to discharge full trays to plunger station P.

Similarly, it is the purpose of upper station $E_E$ to receive empty trays from plunger station P and to convey those trays to empty tray conveyor $C_E$. In order to effect the transport of the respective trays T, elevator E must elevate the loaded trays T to the elevation of plunger P.

Plunger P includes a first array of twelve plungers 18 and a second array of twelve plungers 20. The stroke of plunger arrays 18 and 20 is simultaneous. Both sets of plungers penetrate the tray T and push before them their respective layers of lettuce.

Plunger array 18 penetrates tray T at plunger station P in half 14 of tray T. It causes the lower layer of a carton 70 to be packed.

Similarly, plunger array 20 penetrates the remaining half 16 of tray T. It causes the upper layer of a carton 72 to be packed. Once a carton has been packed by passing under both plunger arrays 18, and 20, it is discharged to a work bank 74. Thereafter, it proceeds to closing station 76 where a worker W causes the carton to be sealed. Finally, the carton is left on the ground at 78 in the wake of the machine for transport to a cooler.

Figure 4A:
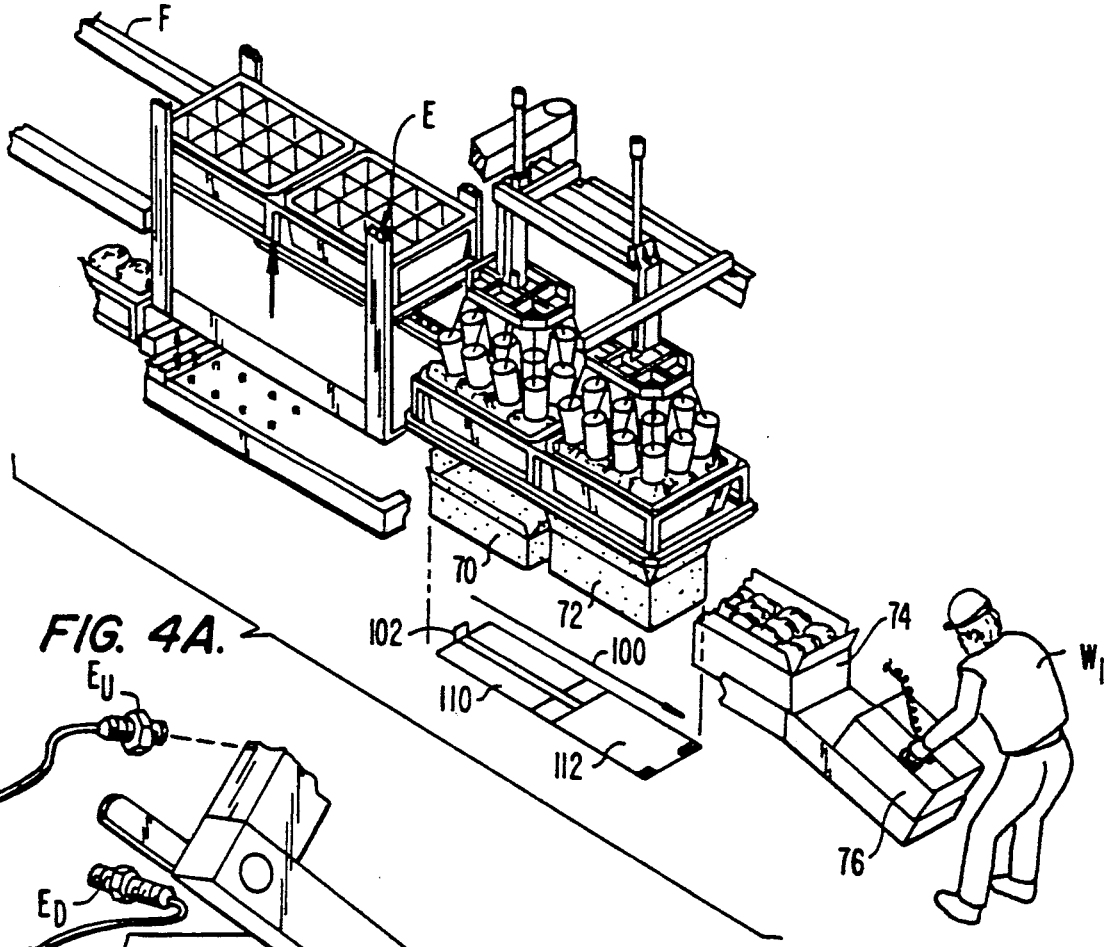
FIG. 4A is an expanded and exploded side perspective detail of the view of FIG. 1 taken at the ends of the conveyors for illustrating the respective ends of the upper empty tray conveyor, the lower full tray conveyor, the elevator in the raised disposition with the lower station having just discharged a full tray for plunging and the upper station loaded with an empty tray which has been most recently plunged at the plunging station.
Figure 4B:
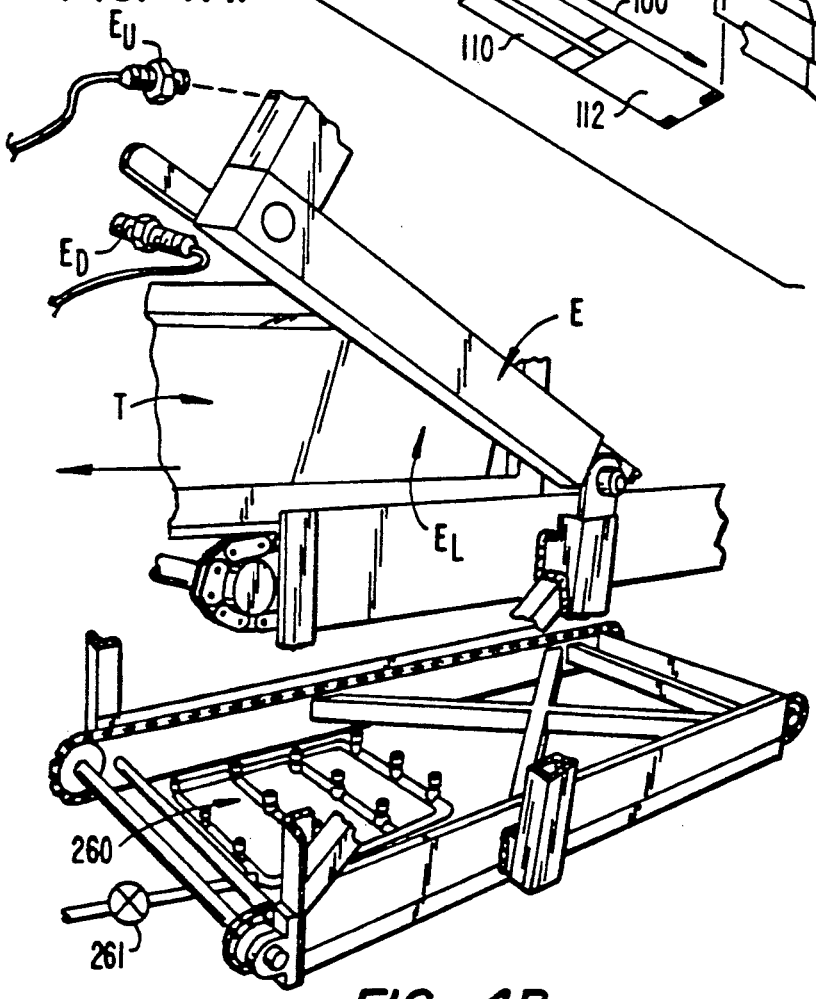
FIG. 4B is an expanded detail of the elevator at the lower station illustrating that portion in the empty state so that the butt washing function built into the elevator can be seen and understood.

Referring to the perspective of FIG. 4A, a view of the plunger P similar to that view shown in FIG. 1B is illustrated. FIG. 4A differs from FIG. 1B in that the position of the respective cartons and the carton conveyor are shown in an exploded relation with respect to the overlying tray T and plungers 18, 20. This explosion makes possible clearer understanding of the respective conveyed sequence.

Specifically, in underlying cartons 70, 72 and 74 there is a conveyance path 100. Conveyance path 100 includes a carton pusher 102. Pusher 102 is in the retracted position once empty carton 70 is placed at the plunging station P.

Once a plunge of the respective plunger groups 18, 20, has occurred, and the bottom layer of carton 70 is packed with lettuce, pusher 102 moves carton 70 forwardly into the position of carton 72.

Carton 72 has had its top layer packed. Thus, it is a fully-loaded carton. It is urged into the position of carton 74. Carton 74 in turn is typically taken by worker W and sealed. Thus, it will be understood that conveyor 100 enables the cartons to be sequentially packed first at their respective bottom layer and thereafter at the respective upper layer with final passage to a sealing station by worker W.

Figure 5A:
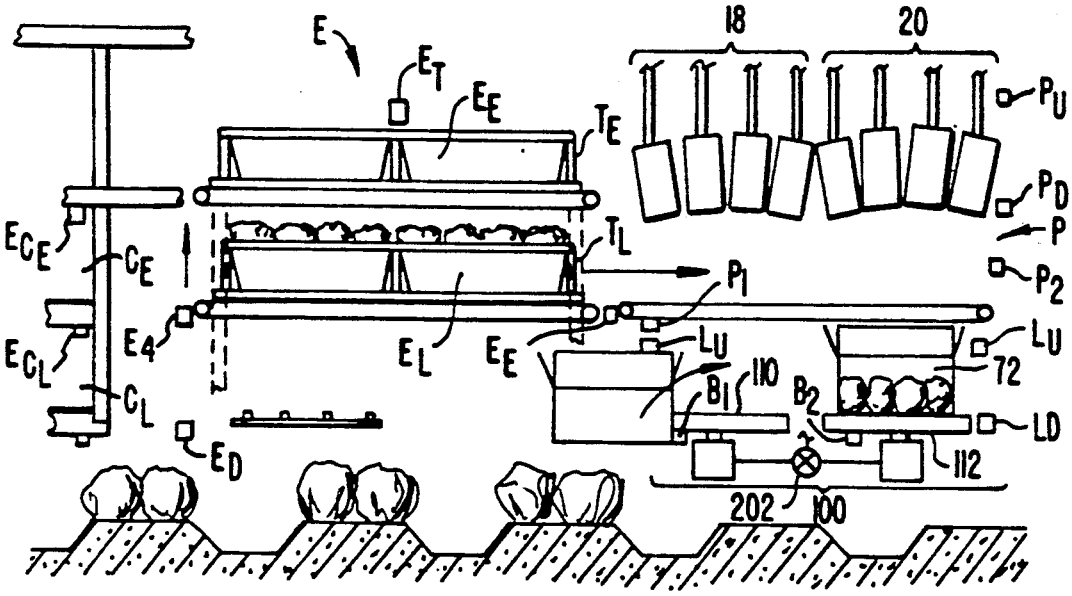
FIGS. 5A-5C are a carton series illustrating the machine sequence of the apparatus illustrated with respect to FIG. 4 illustrating respectively, FIG. 5A illustrating the elevator moved to the upper position to register a full tray at the lower elevator station to the plunger station at an elevation even with the upper conveyor with arrows schematically illustrating the immediate discharge of the full tray to the plunger station.
Figure 5B:
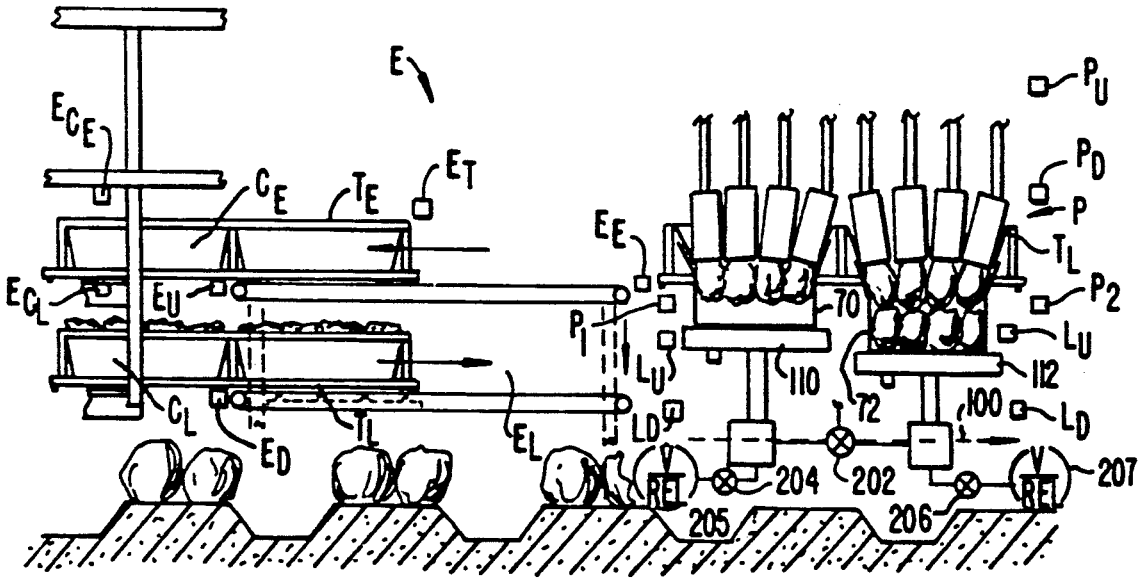
Figure 5C:
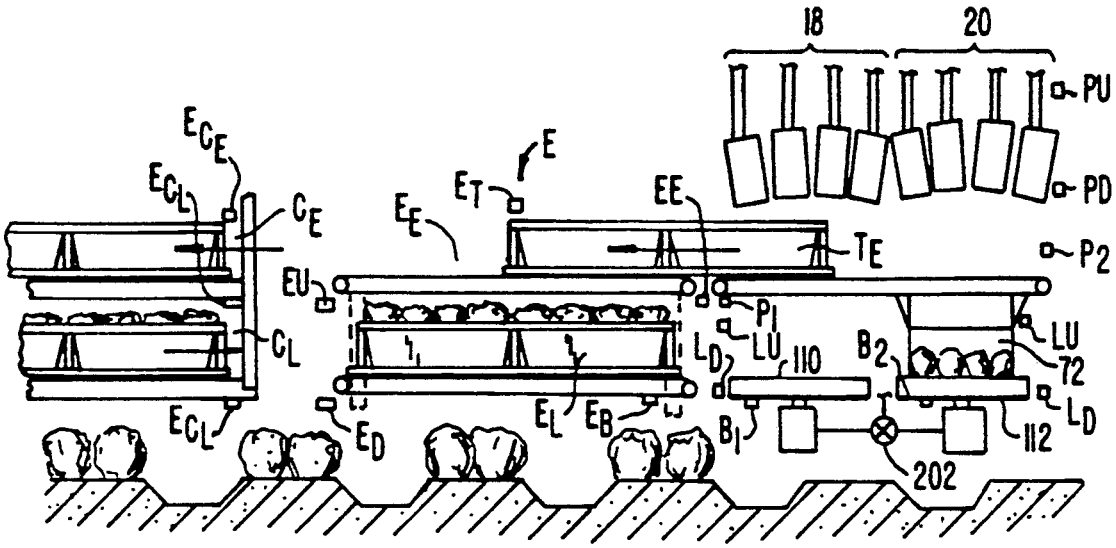
Figure 6A:
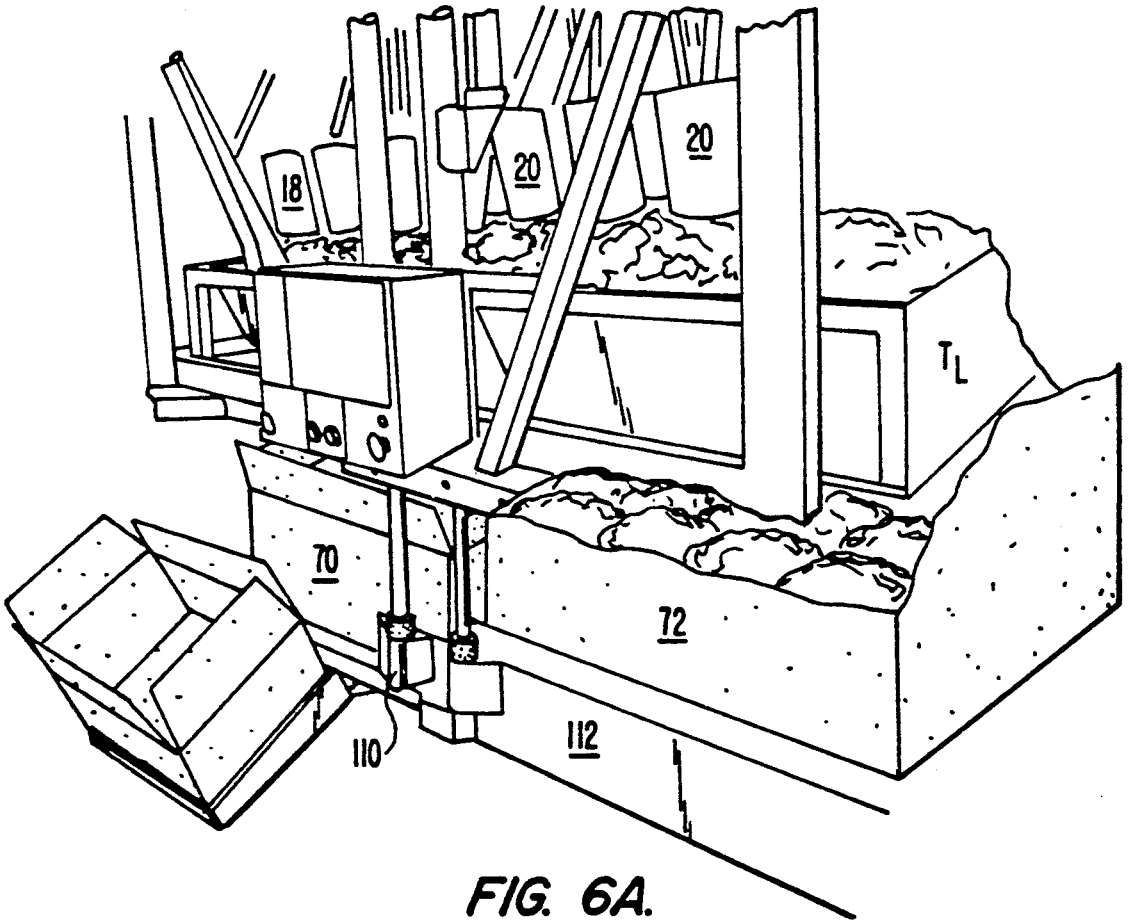
FIG. 6A and 6B are an expanded cartoon series of the carton conveyors below the plunger station with FIG. 6A illustrating the respective elevation of the cartons being packed from their conveyor it being noted that the carton being packed with the lower layer is lifted to a higher elevation with respect to the carton being packed at the upper layer and FIG. 6B illustrates the packed cartons being conveyed between stations with a full carton being conveyed to a lid closing station, a carton with the bottom layer packed being conveyed to the top layer plunging station, and an empty carton being placed to the bottom layer packing station.
Figure 6B:
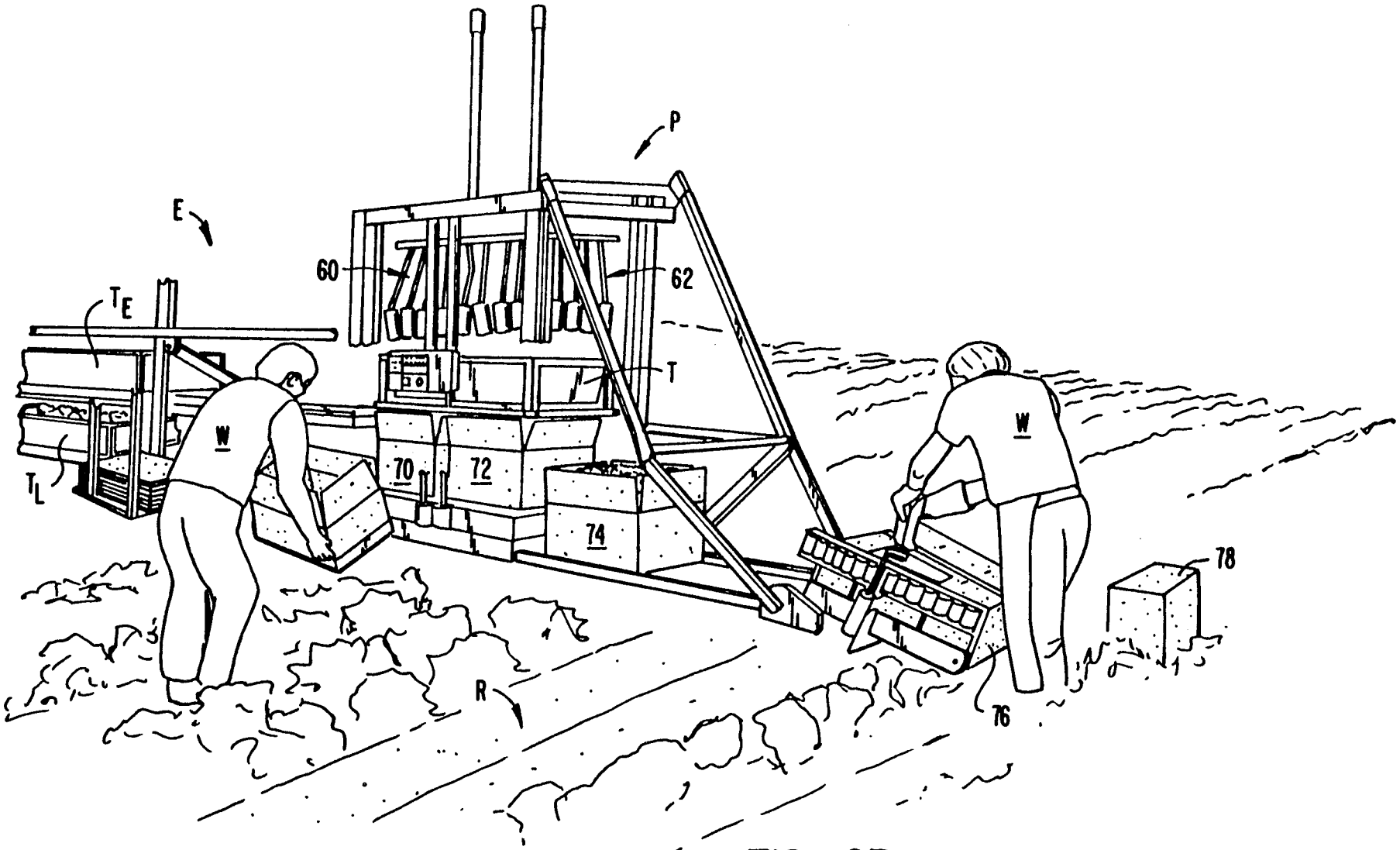

Referring to the carton series of FIG. 5A-5C, a schematic representation of the operation of the conveyors $C_E$, $C_L$, the elevator E and the plunging station P can be understood.

First, it will be understood that the elevator E includes two stations. These stations are an upper empty station $E_E$ and a lower station $E_L$. It is the function of upper station $E_E$ to handle empty trays; similarly, it is the function of lower station $E_L$ to handle full trays. As is set forth in the view of FIG. 5B, when the elevator E is in the lower position, station $E_L$ is loaded from the lower conveyor $C_L$ with a tray packed with lettuce. Similarly, the upper station $E_E$ has off loaded an empty tray $T_E$. Such on loading and off loading of the elevator E occurs during a plunging stroke at plunger P. During raising of elevator E, washing of the freshly cut butts of lettuce in tray portion 14 occurs. This is caused by valve 261 admitting water to spray manifold 260. It will be understood that spray manifold 260 includes one nozzle for each downwardly exposed lettuce head butt. Timing of the washing will be set forth hereafter.

Once plunger P has emptied a tray $T_L$ (see FIG. 5B), off loading of the tray $T_E$ immediately occurs. (See FIG. 5C.) Upon completed off loading of tray $T_E$ and in the usual case, station $E_E$ is loaded with an empty tray. In order to minimize the time between plunging strokes at the plunger station P, elevator E immediately rises. It raises to the position shown in FIG. 5A. Such raising typically occurs before the upper elevator station $E_E$ is off loaded with its particular tray $T_E$. A tray $T_L$ is immediately loaded to the plunger station P.

Thereafter, and when elevator E is lowered to the lower position, plunging at plunger pairs 18 and 20 occurs.

During this plunging operation, the upper elevator station $E_E$ is off loaded with an empty tray $T_E$. Similarly, the lower elevator station $E_L$ is loaded with a full try of lettuce $T_L$.

Attention can be briefly devoted to the schematic of the plunging station. Typically, box 70 is provided with a first lifting station 110. Similarly, box 72 is provided with a second lifting station 112. Between plunging strokes, the respective stations 110, 112 are maintained level with one another. They form a portion of the surface of the conveyor 100 for the respective boxes 70, 72.

Before plunging, these respective stations 110, 112, rise. The plungers then pass through the respective tray $T_L$ carrying the lettuce heads before them. In the case of box 70, the bottom layer is packed; in the case of box 72, the upper layer is packed.

Typically, the respective boxes are lifted by pneumatic systems supporting the respective lifts 110, 112. These pneumatic systems are schematically illustrated in FIGS. 5A-5C and include cylinders with given independently adjustable air pressures. These respective cylinders and their individually adjusted air pressure cause two effects.

Referring to the detail of FIG. 5B, first they cause the respective lifts 110, 112 to be raised. Typically, the lifts are raised in equal elevations. It is preferred to raise the boxes with full air pressure with air admitted through valve 202.

Secondly, and after the lifting of the boxes, the independently adjustable pneumatic cylinders are actuated through valve 204 to relief valve 205 for platform 110 and valve 206 to relief valve 207. These independently adjustable pneumatic cylinders enable the boxes to yield to different elevations under the strokes of the pistons. As yielding, the force with which the cartons 70, 72 are packed with their respective lower and upper layers are independently adjustable.

Operation

Having set forth the general mechanics of this invention, two further groups of explanation are required. First it is necessary to realize how elevator E is actuated. Second, and most logically thereafter, it is necessary to understand the operation of the plunge mechanism P. While it will be understood that each of these mechanisms are interrelated, their operation can as a practical matter be independently discussed.

Further, and sequentially in each case, the computer logic will be discussed. In each case the particular sensors will be set forth. Thereafter, the logic will be addressed.

Sensor Location

ED is the proximity sensor located on frame F which detects the full down position of elevator E (see FIG. 5A).

EU is the proximity sensor located on frame F which detects the full up position of the elevator. This sensor can be located at any location where the full up position of the elevator may be detected.

EB is a photo sensor on the frame which detects the full tray in the bottom elevator station. Note that this tray T has to be completely in the elevator. Thus in the location of sensor EB, it is required that it be positioned to detect full penetration of the tray into the elevator.

ET is the sensor in the top station of the elevator and that one is in about the middle of where the tray sits.

Two sensors P1 are used at the plunge station P. These sensors are at either end of plunge station to ensure that when a signal is emitted that the plunge station P is occupied with a tray T. Consequently, these respective stations are conjunctively wired and positioned to make sure that a tray T is properly centered on the plunge station P. One sensor P1 is at the end of the conveyor to show that the tray is all the way in the plunge station. The remaining sensor P1 is about $\frac{1}{3}$ of the way into the station from the elevator E. The purpose of this sensor is to show that there is a tray moving into the plunger area.

Then $EC_L$ is a photosensor at the end of the full conveyor. It sees the very end of the conveyor before at tray T on conveyor $C_L$ enters the elevator. If a tray is released from the station S just adjacent to the elevator, and passes over the dam blocking the entrance to the elevator, this sensor will be actuated.

$EC_E$ is a photo sensor at the end of the empty conveyor at the top. This photo sensor detects a tray T when it is moving off of the top elevator onto the empty conveyor $C_E$. This sensor is used to make sure that the conveyor end is clear before the elevator is raised or lowered.

EE is utilized to make sure that the plunge P is clear before the elevator moves. EE is a sensor that is between the top elevator and the plunging station conveyor.

Figure 7A:
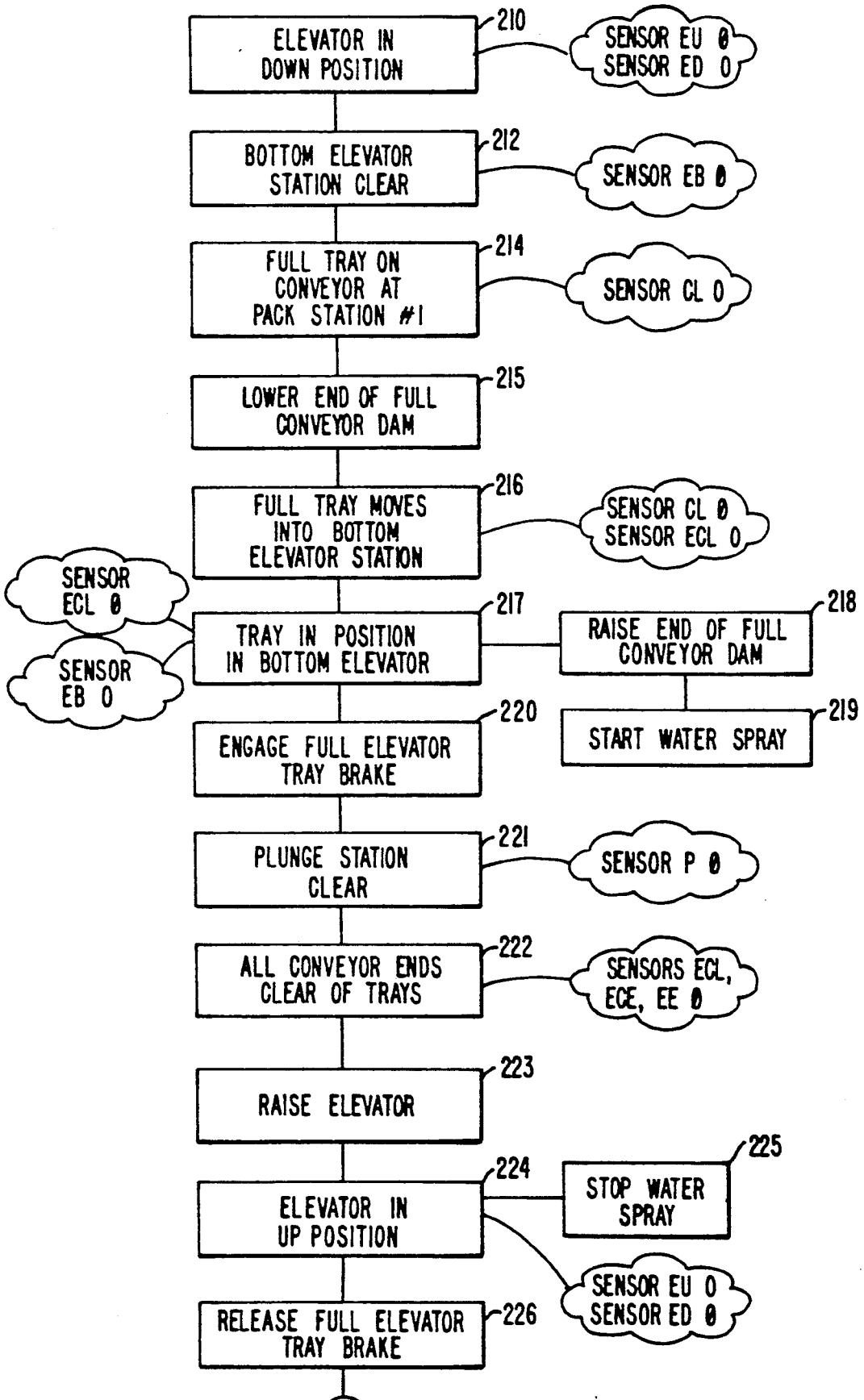
FIGS. 7A and 7B are logic diagrams of tray flow to and from the plunge station for the automated packing of cartons; and, FIG. 8 is a logic diagram of the plunge cycle.
Figure 7B:
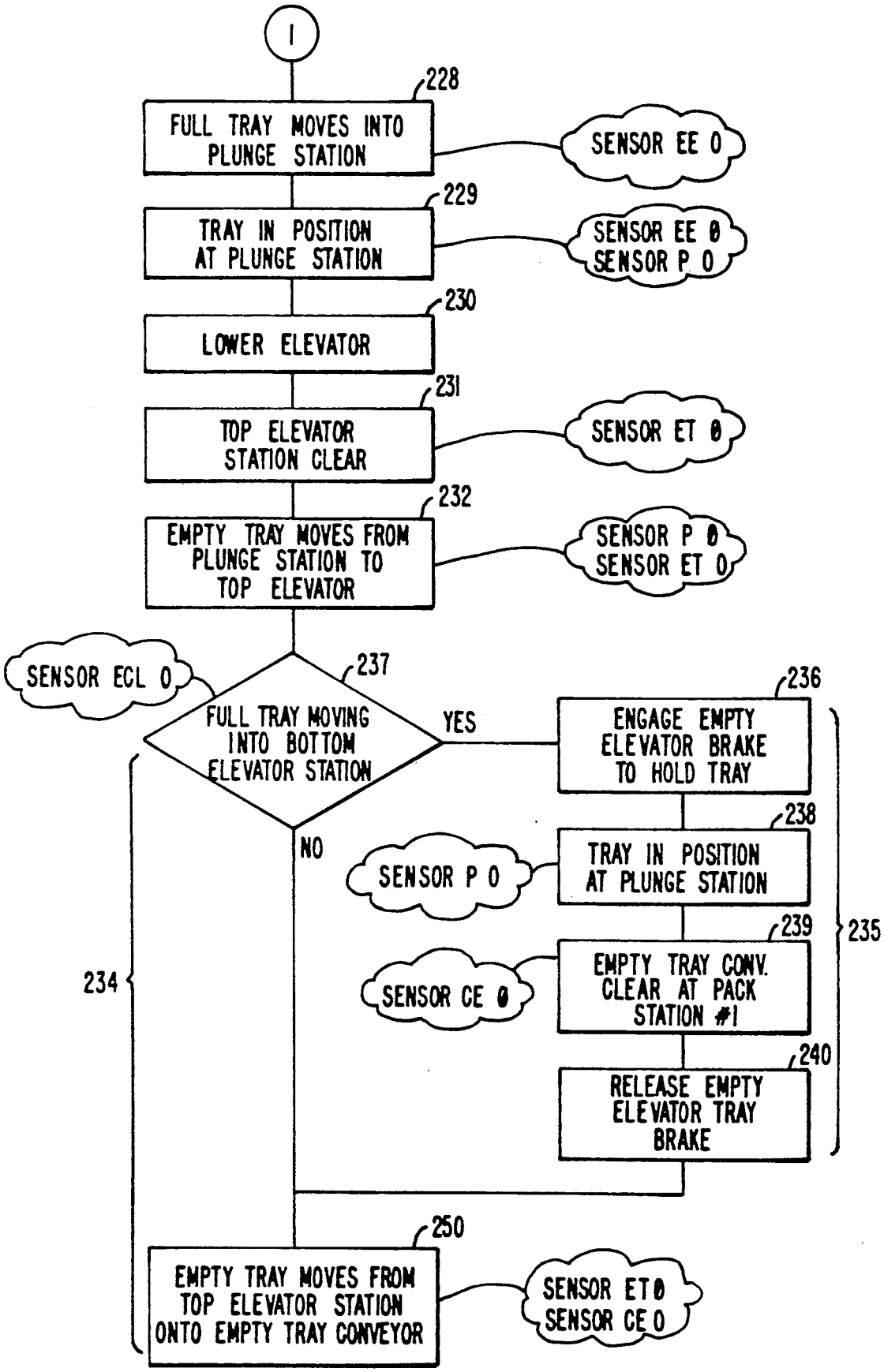
Figure 8:
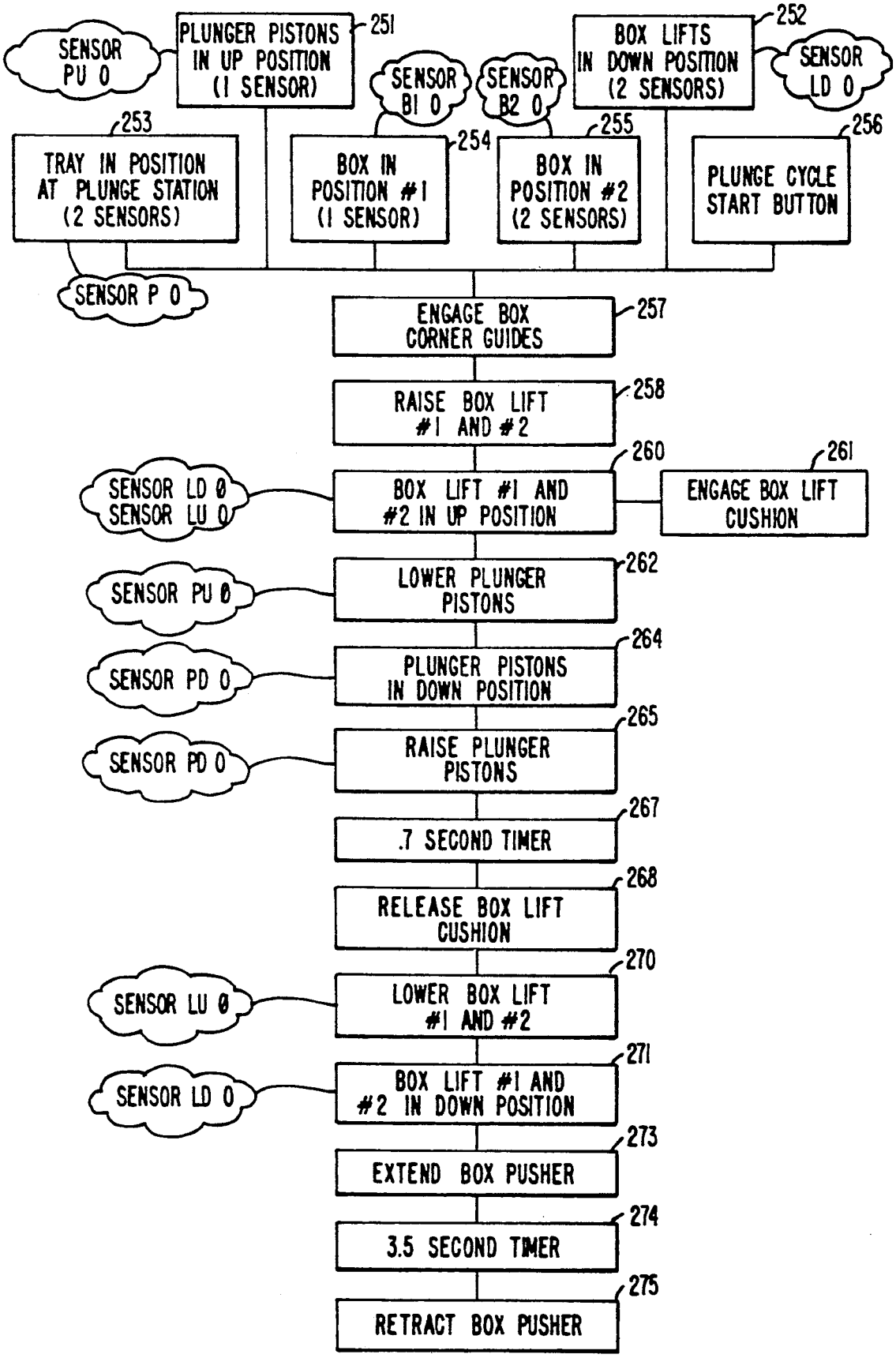

In the illustrated logic of FIG. 7A, 7B and 8, symbols are used for the output of the sensors. In the case of sensors being actuated, a simple circle is utilized. In the case of sensors not seeing a tray or the position of the elevator, the circle includes a line drawn through it. It is believed that by the illustration of both the sensor state and the logic diagram, the operation of the logic can be fully understood.

Logic Operation

Let us now proceed to the logic diagram of FIG. 7A. At the start of the illustrated logic, it is presumed that the elevator E is in the down position (see 210). Sensor EU indicating an up position would be off, and the sensor ED indicating the down position would be on. It is further presumed that bottom elevator station is empty; sensor EB is clear (see 212). The reader will understand, that in the cycle explained, when the elevator has just descended, it would be expected that the bottom elevator station to be clear, having just discharged a full tray T to plunge station P.

In the normal case, there will be a full tray at the pack station S1 closest to the elevator E (see 214). Sensor CL will be on and at that point the dam at the end of the full conveyor would be lowered (see 215). This will enable that particular full tray T to move into the elevator E (see 216).

As the full tray T moves into the elevator, sensor CL clears. Sensor ELC which is the end of conveyor sensor, sees the tray going by (see 217). Finally, sensor ELC is cleared and the sensor EB which is located on the frame in the bottom elevator station, sees that the tray is loaded. At this point, the dam to the elevator E on the conveyor $C_L$ is raised (see 218).

It has been previously mentioned that the freshly cut heads of lettuce on the lower box layer are washed in the field. This particular washing enables what would otherwise be a particularly unsightly area of spoilage highly visible when the packed carton is first opened. Accordingly, when the elevator on the lower station is ready, the water spray utilized with this invention is initiated. This water spray also starts a software clock of three seconds duration. Washing with the water spray continues until either the clock runs or the elevator rises fully to the top (see 219).

It is important to note that when the elevator E is in motion, so-called "elevator brakes" are utilized. Basically these brakes are like clamps that holds the tray in place so that the tray does not move when the elevator is undergoing vertical motion.

Before the elevator E can move to the upward position, it is required to receive a plunge station clear signal. Thus plunge station P is indicated as clear (see 221).

At this point the elevator E is raised (see 223). It will be noted that the system has made sure that all points of conflict with respect to the elevator E are clear; it will not be possible to have a tray T interfere with the raising of the elevator E (see 221 and 222).

When the elevator E moves to the full up position, and presuming that the three second clock has not run, the water spray will cease (see 224 and 225).

When the elevator reaches the full up position, the elevator brakes are released (see 226). The tray T moves to the plunge station P (see 228). When such movement occurs, sensor EE goes clear and we have the tray in position at the plunge station.

It will be understood that the highest priority of the elevator is to keep the plunge station P fully supplied with full trays ready to be plunged. This being the case, the instant that EE goes clear, the elevator is lowered (see 229 and 230).

It is presumed that the reader remembers that the cartons need to be lifted before a so-called "plunge" occurs at the plunge station. This is the subject of logic that will be separately explained in the following text. This being the case, it will now be presumed that a plunge has occurred and that there resides in the top elevator station an empty tray T. The reader will understand, that when the upper elevator station is registered to conveyor $C_E$ and the upper elevator station is not clear, conveyance of an empty tray $T_E$ will occur from the upper elevator station.

When top elevator station is clear, an empty tray moves from the plunge station to the top elevator station (see 231 and 232). This by definition means that the plunge station is clear and the elevator top station sensor ET sees the tray T.

At this point we have alternative logic paths. These can be described as conditional branches (see 237). Where there is sufficient time, the empty tray T will be conveyed over the top of the elevator and onto conveyor $C_E$ (see branch 234). Otherwise, the empty tray T will be held at the top elevator station during the raising and the lowering of the elevator (see branch 235).

As the tray is moving from the plunge station into the elevator, we look to see if there is a full tray moving into the elevator at the bottom. If that condition is true we hold the empty tray in the top elevator and set the elevator station brake (see 236). At that point the elevator E will raise and the full tray at the bottom elevator station will be loaded onto the plunge station P (refer back to 223). Thereafter, the elevator E will come back down (see 230). Once this has occurred, an empty tray sitting in the plunge station P, the plunge will have been completed, the logic will then release the empty elevator station brake and send the empty tray onto the empty conveyor $E_L$ (see 238, 239 and 240).

The alternate branch is simple to understand. If the logic does not see a tray T moving into the bottom elevator station, the empty tray can go straight through from the plunger through the elevator and onto the empty conveyor $C_E$ (see 250).

Plunge Station Sensors

Sensors LU are two photo sensors that are located on the frame that detect the box lifts in the up position. The reader will remember that there are two independently operable box lifts. Consequently, these sensors are conjunctively wired.

Sensors LD are two proximity sensors detecting the down position of the box lifts. These sensors again are conjunctively wired to monitor the individual positions of the independently operable box lifts. Sensors LU and LD can be any kind of sensor—photo or proximity so long as the true position of the box lifts is properly indicated.

PU is a proximity sensor on the frame that detects the plunger pistons in the full up position.

PD is a proximity sensor on the frame that detects the plunger pistons in the full down position.

P are the sensors—mentioned above—that detect the position of the tray T in the plunge position. These sensors are disposed so that the tray T is fully inserted to the plunge station and will not be the subject of interference with the plungers during their respective plunging stroke.

B1 is a photo sensor that is located on the first box lift that detects the presence of a box in the lift station. The reader will remember that the box present at this station is the newly assembled and empty box that is ready to be packed at the bottom layer.

B2 are two photo sensors which are on the second box station. These photo sensors are conjunctively wired. These photo sensors monitor both the presence and the alignment of the box at the second box station. The reader will remember that the box a this station is packed with the bottom layer and awaits packing of the top box layer. The presence of the two sensors is to monitor possible misalignments that occur in the conveyance of the box from the first box lift station.

Plunge Station Logic

Referring to FIG. 8, there are six conditions that must be met before a plunge will occur.

1) Sensor PU must be on. The plungers must be in the full up position (see 251).

2) Sensor LD must be on. The box lifts must be in the full down position (see 252).

3) Sensors P must be on. The tray to be plunged must be fully penetrated to and properly aligned in the plunge station (see 253).

4) Sensor B1 must be on. A box must be present at the first box lift (see 254).

5) Sensors B2 must be on. A conveyed box, properly aligned must be present at the second box lift (see 255).

6) The operator must have indicated that he is ready for the plunge to occur. This indication is accomplished by the operator pushing an enable latch. Without this latch being depressed, the plunge cycle cannot occur (see 256).

When these conditions are met, the box corner guides engage, and the two box lifts raise. In this position, the two box lifts are in a position to meet the downward stroke of the plungers (see 257, 258).

When the box lifts reach their up position, of course the lift's down sensor will be off and the lift up sensor would be on, at that point you engage a box lift cushion. This automatically and independently regulates the air pressure on each of the box lifts so that the box yield under the correct air pressure as the plungers descend (see 260 and 261).

Then we will begin to lower the plunger piston (see 262). At this point the plunger up sensor would go off.

When the plunger pistons reach their down position, fully down, the plunge down sensor PD would come on (see 264). At that point when the plungers reach their down most position, we begin to raise them back up again, and at that point when we start to raise the plungers (see 265). At this time, we start the clock at 0.7 seconds before we release the box lift cushion (see 267).

And this alleviates a very interesting problem. The problem is the catching of leaves between the plungers and the sides of the box. By raising the plunger pistons first we allow the leaves to be disengaged and to fall in a natural and clean-looking array on the packed lettuce in the respective cartons as the packing occurs. The reason that this is effective is because the individual plungers undergo separation as they are raised.

Sensor LU goes off as the box lifts are lowered (see 268 and 270). When complete lowering occurs, sensors LD sense the complete lowering of the box lifts (see 271). Thereafter the extend box pusher conveys the box at the first box lift to the second box lift, and the box now fully packed—at the second box lift to the closing station (see 273).

Finally, a 3.5 second clock runs, the pusher is retracted, and the cycle is repeated (see 274 and 275).

What is claimed is:

1. In combination a tray and carton packing station for packing cartons with lettuce, said combination comprising:

a lettuce holding tray having first and second matrices of cell positions with each cell position defining a lettuce head receiving position with one said matrix defining respective rows and columns for receiving lettuce heads oriented for packing to a bottom carton layer and the other said matrix defining respective rows and columns for receiving lettuce heads oriented for packing to an upper carton layer;

each said lettuce holding tray at each said side wall including at least one flexible side disposed inwardly at the bottom of said cell for restricting the dimension of said cell to permit said cell to hold a head of lettuce and further to permit said held head of lettuce to be forced out the bottom of said cell;

respective corresponding first and second matrices of plungers for overlying said first and second matrices of cell positions with one said plunger of each plunger matrix corresponding to one said cell of said tray matrix;

conveyor means underlying said tray for transporting first and second cartons underlying said tray, said first carton underlying a first matrix of said tray and said second carton underlying a second matrix of said tray;

means for plunging said first and second matrices of plungers through each said respective cell matrix of said trays for causing heads of lettuce in said trays to move ahead of said plungers and into said underlying cartons to pack a lower layer of one carton from one plunger matrix and to pack an upper layer of the other carton from the other plunger matrix; and, means for conveying said cartons underlying said tray with said carton having said bottom layer packed from said first matrix being moved to a position underlying said second matrix for packing of said top layer whereby one adjacent said carton is packed at said bottom layer and the other adjacent said carton is packed at said top layer.

2. The combination of claim 1 and wherein said means for conveying defines a first station underlying said first tray matrix for receiving an empty carton, a second station underlying said second matrix for receiving a carton packed at said bottom layer only, and a third station adjacent said second station for closing the top of a carton fully packed with lettuce.

3. The combination of claim 2 and wherein said means for conveying further includes:

means for raising said first station with said empty carton during operation of said plungers; and, means for raising said second station with said carton packed at said bottom layer only during operation of said plungers.

4. The combination of claim 3 and wherein:

said means for raising said first station biases said first carton with a first adjustable force towards said plungers; and said means for raising said second station biases said second carton with a second independently adjustable force towards said plungers.

5. The combination of claim 1 and including:

a packing station remote from said means for plunging for enabling said tray to be packed with lettuce; and, conveyor means for conveying full lettuce receiving trays from said packing station to said plunger means and conveying empty lettuce receiving trays from said plunger means to said packing station.

6. In combination with a lettuce harvesting machine having a plunging station for packing trays of overlying lettuce into receiving underlying cartons;

a plurality of picking stations for harvesting produce;

a plunging station for packing cartons with produce picked at said picking stations;

a plurality of lettuce holding trays for conveyance on each said conveyor, each said tray comprising in combination a matrix of cell positions with each cell position defining a lettuce head receiving position defining respective rows and columns for receiving lettuce heads oriented for packing to a carton layer;

each said lettuce holding tray at each said side wall including at least one flexible side disposed inwardly at the bottom of said cell for restricting the dimension of said cell to permit said cell to hold a head of lettuce and further to permit said held head of lettuce to be force out the bottom of said cell;

first and second overlying conveyors extending between said picking stations and said plunging station including, a first conveyor at a first elevation for conveying trays of empty lettuce holding trays from a plunging station to picking stations;

a second conveyor at a second and different elevation for conveying trays of full lettuce holding trays from picking stations to a plunging station for packing to cartons;

an elevator disposed at the end of said conveyors and moveable in elevation with respect to said conveyors and said plunging station to receive and discharge lettuce holding trays to and from said conveyors and to and from plunging station for the packing of lettuce within said lettuce holding trays at said plunging station to said cartons;

means for successively raising and lowering said elevator station with said lettuce receiving trays to fill and discharge said lettuce holding trays from said plunging station.

7. The combination of claim 6 and wherein each said tray includes;

first and second matrices of cell positions with each cell position defining a lettuce head receiving position with one said matrix defining respective rows and columns for receiving lettuce heads oriented for packing to a bottom carton layer and the other said matrix defining respective rows and columns for receiving lettuce heads oriented for packing to an upper carton layer.

8. The combination of claim 6 and wherein:

said elevator has a first station for discharging full lettuce trays to said plunging station and a second station for receiving empty lettuce trays from said plunging station.

9. The combination of claim 8 and wherein:

said elevator stations overlie one another.

10. A process for packing cartons with lettuce, said combination comprising:

providing a lettuce holding tray having first and second matrices of cell positions with each cell position defining a lettuce head receiving position with one said matrix defining respective rows and columns for receiving lettuce heads oriented for packing to a bottom carton layer and the other said matrix defining respective rows and columns for receiving lettuce heads oriented for packing to an upper carton layer;

providing to each said lettuce holding tray at each said side wall including at least one flexible side disposed inwardly at the bottom of said cell for restricting the dimension of said cell to permit said cell to hold a head of lettuce and further to permit said held head of lettuce to be force out the bottom of said cell;

providing a plunging station having respective corresponding first and second matrices of plungers for overlying said first and second matrices of cell positions with one said plunger of each plunger matrix corresponding to one said cell of said tray matrix;

providing conveyor means underlying said tray for transporting first and second cartons underlying said tray, said first carton underlying a first matrix of said tray and said second carton underlying a second matrix of said tray;

plunging said first and second matrices of plungers through each said respective cell matrix of said trays for causing heads of lettuce in said trays to move ahead of said plungers and into said underlying cartons to pack a lower layer of one carton from one plunger matrix and to pack an upper layer of the other carton from the other plunger matrix; and, conveying said cartons underlying said tray with said carton having said bottom layer packed from said first matrix being moved to a position underlying said second matrix for packing of said top layer whereby one adjacent said carton is packed at said bottom layer and the other adjacent said carton is packed at said top layer.

11. The process of claim 10 and including the steps of:

providing a first station underlying said first tray matrix for receiving an empty carton;

providing a second station underlying said second matrix for receiving a carton packed at said bottom layer only;

providing a third station adjacent said second station for closing the top of a carton fully packed with lettuce; and, conveying cartons between said stations between said plunging steps.

12. The process of claim 11 and including the steps of:

raising said first station with said empty carton during operation of said plungers; and, raising said second station with said carton packed at said bottom: layer only during operation of said plungers.

13. The process of claim 12 and wherein:

said raising step includes biasing said first carton with a first adjustable force towards said plungers; and biasing said second carton with a second adjustable force towards said plungers.

14. The of claim 10 and including:

providing a packing station remote from said means for plunging for enabling said tray to be packed with lettuce; and, conveying full lettuce receiving trays from said packing station to said plunging station and conveying empty lettuce receiving trays from said plunging station to said packing station.

15. A lettuce harvesting process comprising the steps of:

providing a plurality of picking stations for harvesting produce;

providing a plunging station for packing cartons with produce picked at said picking stations;

providing a plurality of lettuce holding trays for conveyance on each said conveyor, providing each said tray with a matrix of cell positions with each cell position defining a lettuce head receiving position defining respective rows and columns for receiving lettuce heads oriented for packing to a carton layer;

providing each said lettuce holding tray at each said side wall including at least one flexible side disposed inwardly at the bottom of said cell for restricting the dimension of said cell to permit said cell to hold a head of lettuce and further to permit said held head of lettuce to be force out the bottom of said cell;

providing first and second overlying conveyors extending between said picking stations and said plunging station including, conveying at a first elevation trays of empty lettuce holding trays from a plunging station to picking stations;

conveying at a second and different elevation trays of full lettuce holding trays from picking stations to a plunging station for packing to cartons;

providing an elevator disposed at the end of said conveyors; and, moving said elevator in elevation with respect to said conveyors and said plunging station to receive and discharge lettuce holding trays to and from said conveyors and to and from plunging station for the packing of lettuce within said lettuce holding trays at said plunging station to said cartons.

16. The process of claim 15 and including the steps of:

providing each said tray with first and second matrices of cell positions with each cell position defining a lettuce head receiving position with one said matrix defining respective rows and columns for receiving lettuce heads oriented for packing to a bottom carton layer and the other said matrix defining respective rows and columns for receiving lettuce heads oriented for packing to an upper carton layer.

17. The process of claim 15 comprising the steps of:

providing said elevator with a first station for discharging full lettuce trays to said plunging station and a second station for receiving empty lettuce trays from said plunging station;

discharging full trays to said plunging station when said elevator is at a first elevation; and, receiving empty trays from said plunging station when said elevator is at a second elevation.

18. The process of claim 17 and wherein:

said provided elevator stations overlie one another.

19. The process of claim 18 and wherein:

simultaneously conveying to one elevator station from said plunger station and empty tray while simultaneously conveying to said other elevator station a full tray.

20. The process of claim 19 and wherein:

said elevator is raised and lowered before said empty tray is conveyed from said one elevator station towards said packing stations whereby said empty tray is raised and lowered before conveyance to said packing stations.

21. The process of claim 19 and wherein:

said empty tray is conveyed across said one elevator station before said elevator is raised and lowered.

22. A process for packing cartons with lettuce, said combination comprising:

providing a lettuce holding tray having first and second matrices of cell positions with each cell position defining a lettuce head receiving position with one said matrix defining respective rows and columns for receiving lettuce heads oriented for packing to a bottom carton layer and the other said matrix defining respective rows and columns for receiving lettuce heads oriented for packing to an upper carton layer;

providing to each said lettuce holding tray at each said side wall including at least one flexible side disposed inwardly at the bottom of said cell for restricting the dimension of said cell to permit said cell to hold a head of lettuce and further to permit said held head of lettuce to be force out the bottom of said cell;

providing a plunging station having respective corresponding first and second matrices of plungers for overlying said first and second matrices of cell positions with one said plunger of each plunger matrix corresponding to one said cell of said tray matrix;

providing conveyor means underlying said tray for transporting first and second cartons underlying said tray, said first carton underlying a first matrix of said tray and said second carton underlying a second matrix of said tray;

washing with water at least one of said tray matrices at the bottom thereof for cleaning the butts of said lettuce heads;

plunging said first and second matrices of plungers through each said respective cell matrix of said trays for causing heads of lettuce in said trays to move ahead of said plungers and into said underlying cartons to pack a lower layer of one carton from one plunger matrix and to pack an upper layer of the other carton from the other plunger matrix; and, conveying said cartons underlying said tray with said carton having said bottom layer packed from said first matrix being moved to a position underlying said second matrix for packing of said top layer whereby one adjacent said carton is packed at said bottom layer and the other adjacent said carton is packed at said top layer whereby said butts of said one matrix are washed before said carton is packed with lettuce.

23. The process of claim 22 and wherein said washing step includes:

washing the matrix of said lettuce heads in said lettuce tray that packs to the bottom of said carton.

24. The invention of claim 7 and wherein said elevator includes:

means for washing with water at least one of said matrices of said tray.

25. The invention of claim 24 and wherein said means for washing with water is disposed to wash said matrix of said tray packed to the bottom of said first carton.

* * * * *